US010604920B2

(12) United States Patent
Schumacher

(10) Patent No.: US 10,604,920 B2
(45) Date of Patent: Mar. 31, 2020

(54) DRAINAGE SYSTEMS FOR BATHTUBS AND SINKS

(71) Applicant: Kohler Co., Kohler, WI (US)

(72) Inventor: Jeffrey A. Schumacher, Port Washington, WI (US)

(73) Assignee: KOHLER CO., Kohler, WI (US)

( * ) Notice: Subject to any disclaimer, the term of this patent is extended or adjusted under 35 U.S.C. 154(b) by 44 days.

(21) Appl. No.: 15/989,057

(22) Filed: May 24, 2018

(65) Prior Publication Data

US 2019/0360185 A1 Nov. 28, 2019

(51) Int. Cl.
*E03C 1/22* (2006.01)

(52) U.S. Cl.
CPC ..... *E03C 1/22* (2013.01)

(58) Field of Classification Search
CPC ..... E03C 1/22
USPC ..... 4/679; 210/153
See application file for complete search history.

(56) References Cited

U.S. PATENT DOCUMENTS

| | | | | |
|---|---|---|---|---|
| 4,516,278 | A | 5/1985 | Lamond | |
| 5,944,985 | A * | 8/1999 | Bowman | B01D 61/08 210/153 |
| 6,193,879 | B1 * | 2/2001 | Bowman | B01D 61/08 210/153 |
| 6,408,887 | B2 | 6/2002 | Rahimzadeh | |
| 6,588,803 | B2 | 7/2003 | Vila | |
| 6,651,272 | B2 * | 11/2003 | Bowman | B01D 61/10 285/132.1 |
| 6,845,527 | B1 * | 1/2005 | Kohn | E03C 1/12 137/247.41 |
| 6,859,956 | B2 | 3/2005 | Mantyla | |
| 7,131,150 | B1 | 11/2006 | Havens | |
| D599,447 | S | 9/2009 | Cummings | |
| 8,234,726 | B2 | 8/2012 | Shafik | |
| 2003/0024568 | A1 * | 2/2003 | Bowman | B01D 61/10 137/217 |
| 2006/0265804 | A1 | 11/2006 | Santa Ana | |
| 2008/0143102 | A1 | 6/2008 | Graybeal | |
| 2011/0277232 | A1 | 11/2011 | Shilo | |
| 2017/0198466 | A1 | 7/2017 | Hall | |
| 2017/0292254 | A1 | 10/2017 | Gogoulis | |

FOREIGN PATENT DOCUMENTS

| | | |
|---|---|---|
| CN | 204781157 | 11/2015 |
| GB | 2090883 | 7/1982 |

OTHER PUBLICATIONS

Home Depot Reference; 3 in. c 4 in. DWV PVC 90 degree Reducing Hub Elbow; Jan. 23, 2018; 3 pages.

* cited by examiner

*Primary Examiner* — Lori L Baker
(74) *Attorney, Agent, or Firm* — Foley & Lardner LLP

(57) ABSTRACT

A drainage system for use in a bathtub, sink, or the like. A bathtub may include a bath basin and a basin drain that drains water from the bath basin. The drainage system forms a p-trap. The drainage system includes an inlet elbow having an inlet and an outlet. The inlet is fluidly connected to an outlet of the basin drain. The drainage system also includes a u-bend conduit having an inlet and an outlet. The inlet is fluidly connected to the outlet of the first elbow. The drainage system also includes a second elbow having an inlet and an outlet. The inlet is fluidly connected to the outlet of the u-bend conduit. The outlet is configured to connect to an inlet of a fluid drain.

20 Claims, 5 Drawing Sheets

DRAINAGE SYSTEMS FOR BATHTUBS AND SINKS

BACKGROUND

The present disclosure relates generally to drainage systems and, more specifically, to drainage systems for bathtubs, sinks, or the like.

Many bathtubs include 1.5" polyvinyl chloride (PVC) pipe drainage systems. These drainage systems remove water from a bath basin. However, given the 1.5" piping size, the water may drain from the bath basin relatively slowly. This can be particularly problematic when it is desirable to drain the water quickly. Such issues arise when a person is incapable of exiting the bathtub until the water drains completely or to a certain level. For instance, where the bathtub is a walk-in bathtub, the person must wait until water drains beneath a door until the person can open the door and exit the bathtub. While waiting, the person may begin to experience a feeling of cold from the effects of the temperature difference between the water and the ambient air. For some people, this may be an issue given age or infirmity.

It may therefore be advantageous to include a drainage system that can drain water from the bath basin quicker than standard drainage systems. Such a drainage system may resolve the issues resulting from slower drainage systems.

SUMMARY

One implementation of the present disclosure includes a bath or sink basin drainage system. The basin drainage system includes a basin defining an interior portion. The basin drainage system includes a basin drain arranged towards a bottom of the interior portion of the basin. The basin drain has an outlet for draining water from the interior portion of the basin. The basin drainage system includes a drainage system forming a p-trap. The drainage system includes a first elbow having an inlet and an outlet. The inlet has a first inner diameter and is fluidly connected to the outlet of the basin drain. The outlet has a second inner diameter that is larger than the first inner diameter. The drainage system includes a u-bend conduit having an inlet and an outlet. The inlet is fluidly connected to the outlet of the first elbow. An inner diameter of each of the inlet and the outlet of the u-bend conduit is the same size as the second inner diameter of the outlet of the first elbow. The drainage system includes a second elbow having an inlet and an outlet. The inlet is fluidly connected to the outlet of the u-bend conduit. The outlet is configured to connect to an inlet of a fluid drain.

Another implementation of the present disclosure includes a walk-in bathtub. The walk-in bathtub includes a bath basin defining an interior portion. The walk-in bathtub includes a door pivotable inwardly towards the interior portion of the bath basin. The walk-in bathtub includes a bath drain arranged towards a bottom of the interior portion of the bath basin. The bath drain has an outlet for draining water from the interior portion of the bath basin. The walk-in bathtub includes a drainage system forming a p-trap. The drainage system includes a first elbow having an inlet and an outlet. The inlet has a first inner diameter and is fluidly connected to the outlet of the bath drain. The outlet has a second inner diameter that is larger than the first inner diameter. The drainage system includes a u-bend conduit having an inlet and an outlet. The inlet is fluidly connected to the outlet of the first elbow. An inner diameter of each of the inlet and the outlet of the u-bend conduit is the same size as the second inner diameter of the outlet of the first elbow. The drainage system includes a second elbow having an inlet and an outlet. The inlet is fluidly connected to the outlet of the u-bend conduit. The outlet is configured to connect to an inlet of a fluid drain.

Another implementation of the present disclosure includes a drainage system for a bathtub. The drainage system includes a first elbow having an inlet and an outlet. The inlet has a first inner diameter and is configured to fluidly connect to an outlet of a basin drain that is arranged to drain water from an interior portion of a bath basin. The outlet has a second inner diameter that is larger than the first inner diameter. The drainage system includes a u-bend conduit having an inlet and an outlet. The inlet is fluidly connected to the outlet of the first elbow. An inner diameter of each of the inlet and the outlet of the u-bend conduit is the same size as the second inner diameter of the outlet of the first elbow. The drainage system includes a second elbow having an inlet and an outlet. The inlet is fluidly connected to the outlet of the u-bend conduit. The outlet is configured to connect to an inlet of a fluid drain.

DETAILED DESCRIPTION

Referring generally to the FIGURES, described herein is a drainage system for use in a bathtub, sink, or the like. For instance, a walk-in bathtub may include a bath basin and a basin drain that drains water from the bath basin. The drainage system includes an inlet elbow having an inlet and an outlet. The inlet is fluidly connected to an outlet of the basin drain. The drainage system also includes a u-bend conduit having an inlet and an outlet. The inlet is fluidly connected to the outlet of the first elbow. The drainage system also includes a second elbow having an inlet and an outlet. The inlet is fluidly connected to the outlet of the u-bend conduit. The outlet is configured to connect to an inlet of a fluid drain.

In operation, the drainage system drains water received from the outlet of the basin drain to a fluid drain inlet (e.g., an inlet to a main fluid drain for a residential, commercial, etc. property). The inlet and outlet for the u-bend conduit may each have an inner diameter that is greater than an inner diameter of the inlet for the inlet elbow. Accordingly, the inlet for the inlet elbow may have an inner diameter that is less than an inner diameter for the outlet of the inlet elbow. In these embodiments, water may be drained from the bath basin at a greater rate than standard drain rates due to the larger inner diameters.

Figure 1:
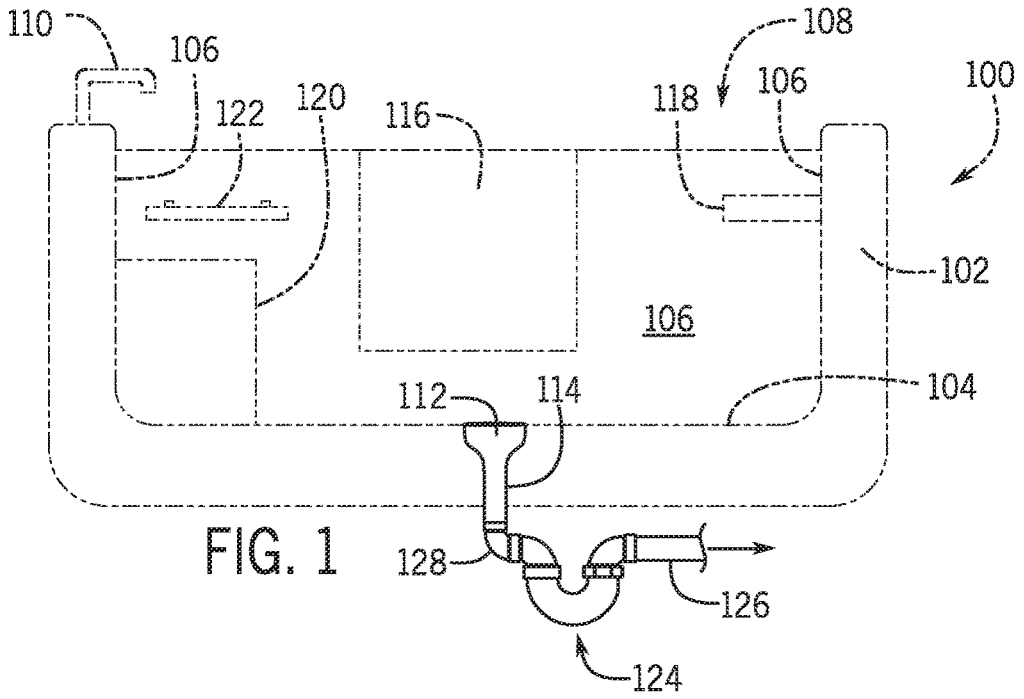
FIG. 1 is a view of a bathtub according to an exemplary embodiment.
Figure 2:
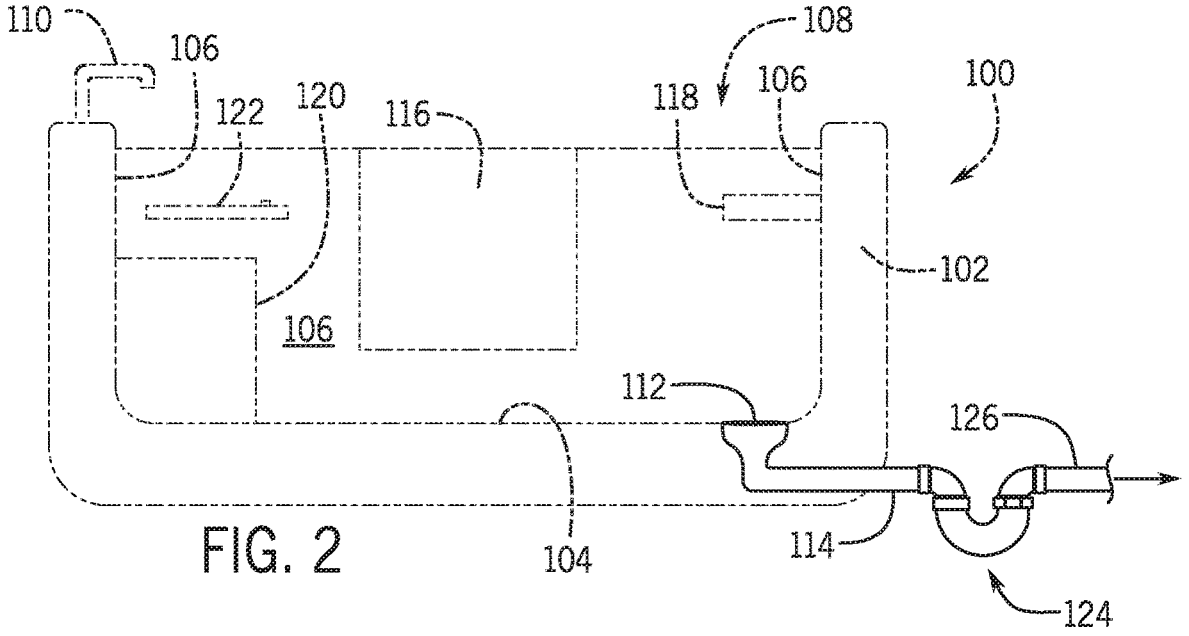
FIG. 2 is a view of a bathtub according to another exemplary embodiment.

Referring now to FIG. 1 and FIG. 2, two bathtubs 100 are shown, according to exemplary embodiments. While FIG. 1 and FIG. 2 show two different bathtubs 100, many of the same reference numerals are used to identify the same or similar components. The bathtub 100 is shown to include a bath basin 102. The bath basin 102 may include a floor 104 and a number of walls 106. The walls 106 and floor 104 may together define an interior portion 108 of the bath basin 102. The interior portion 108 may be the portion of the bath basin 102 where water resides (e.g., inside the bath basin 102). While many of the embodiments described herein are described with reference to the bathtub 100, it is noted that many embodiments may be applied to, for instance, sinks, toilets, or other household or commercial bathroom or kitchen basins which require draining of water.

The bathtub 100 is shown to include a faucet 110. The faucet 110 may be fluidly connected to a water source and provide water to the interior portion 108 of the bath basin 102. The bathtub 100 may include one or more temperature controls (e.g., knobs, levers, handles, etc.) for regulating a temperature of water provided to the interior portion 108 of the bath basin 102.

The bathtub 100 is shown to include a basin drain 112. The basin drain 112 is shown to be arranged towards a bottom of the interior portion 108 of the bath drain 112. The basin drain 112 is shown to include an outlet 114. The outlet 114 may receive water from the basin drain 112 and may be used for draining water from the interior portion 108 of the basin 102. In some instances, the bath drain 112 may be positioned towards a center of the interior portion 108 (e.g., as shown in FIG. 1). In other instances, the bath drain 112 may be positioned near a wall 106 of the basin 102 (e.g., as shown in FIG. 2). In both of these instances, the floor 104 may be shaped (or sloped) to induce water movement towards the bath drain 112. Additionally, in some instances, the outlet 114 may extend from the basin 102 in a horizontal orientation (shown in FIG. 1). In instances such as these, the bath drain 112 may extend substantially vertically. In other instances, the outlet 114 may extend from the basin 102 in a vertical orientation (shown in FIG. 2). In instances such as these, the bath drain 112 may extend substantially horizontally. In some embodiments, the bath drain 112 may be pitched to induce water flow towards the outlet 114. Various modifications and alterations of the bath drain 112 and outlet 114 may be made according to various design requirements and/or needs.

In some embodiments, the bathtub 100 may be a walk-in bathtub (as shown in FIG. 1 and FIG. 2). In these embodiments, the bath basin 102 may include a door 116 in one of the walls 106. The door 116 may pivot open and shut. The door 116 may pivot open towards the interior portion 108 of the bath basin 102 to permit ingress to the bath basin 102 (e.g., by a bather). The door 116 may then be pivoted shut. In operation, the bather may position themselves within the interior portion 108 of the bath basin 102 and shut the door 116. The bather may then fill the interior portion 108 of the bath basin 102 to a desired water level. As water fills the interior portion 108, water presses up against the door 116 and therefore maintains the door 116 in the closed position. The bather then bathes and, once complete, drains water from the interior portion 108. However, until the water level is beneath the bottom of the door 116, the door 116 may not be opened by the bather. As such, the bather must wait in the interior portion 108 of the bath basin 102 for water to drain beneath the door 116.

In some embodiments, the bath basin 102 may include additional features. For instance, the bath basin 102 may include a number of ledges 118 for supporting various bathing products (e.g., shampoo, conditioner, soap, body wash, etc.). Additionally, the bath basin 102 may include a seat 120 for a person to sit down while bathing. In some embodiments, the bath basin 102 may further include a hand rail 122 for assisting a seated person to stand (and vice versa).

The bathtub 100 shown to include a drainage system 124. The drainage system 124 may be arranged to drain water received from the outlet 114 of the bath drain 112 to a fluid drain inlet 126 (e.g., a residential, commercial, etc. fluid drain).

The drainage system 124 may include at least one elbow. Each elbow described herein may include an inlet and an outlet, as will be discussed in greater detail below. Depending on orientation of the drainage system 124, various elbows may be arranged to make various turns (e.g., 90° turns, for instance) such that the water traversing therethrough may be moved to different locations. In instances where the outlet 114 extends from the bath basin 102 in a horizontal orientation, the drainage system 124 may include a first elbow 128. The first elbow 128 may be fluidly coupled to the outlet 114 where the first elbow 128 has a horizontal inlet and vertical outlet (as shown in FIG. 1). In instances where the outlet extends outwardly from the bath basin 102 in a vertical orientation, the first elbow 128 may be forgone (as shown in FIG. 2). Accordingly, the outlet 114 of the bath drain 112 may extend vertically, or a first elbow 128 may be provided to yield a vertically-extending outlet. Additionally, various conduits may be provided to extend the length of the outlet 114 as may be needed or desirable.

Figure 3:
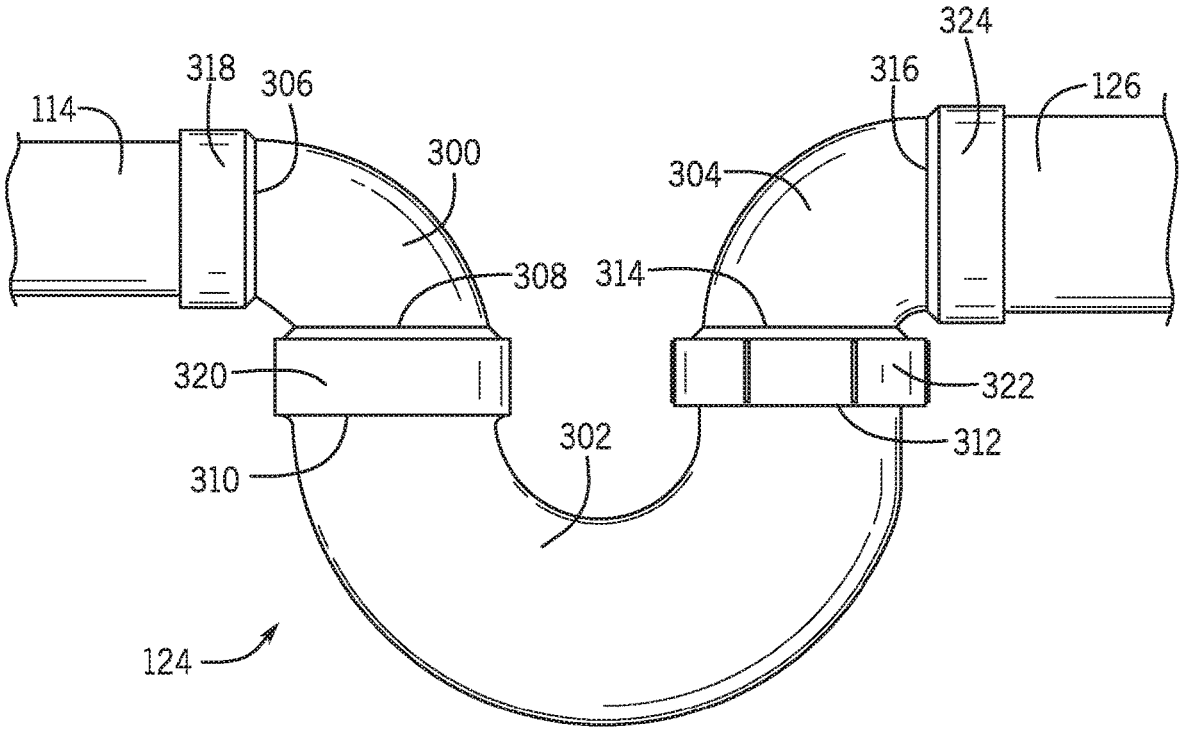
FIG. 3 is a drainage system configured to be implemented in the bathtubs of FIG. 1 and FIG. 2, according to an exemplary embodiment.
Figure 4:
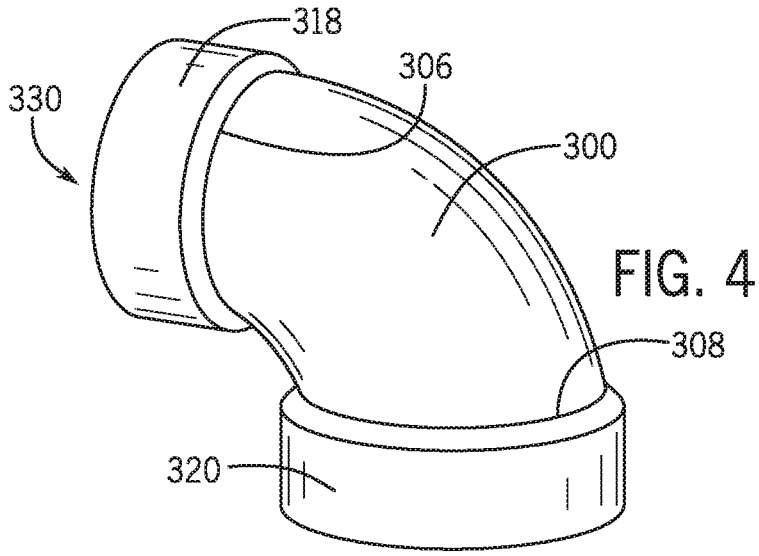
FIG. 4-FIG. 9 are various views of an elbow of the drainage system of FIG. 3, according to an exemplary embodiment.
Figure 5:
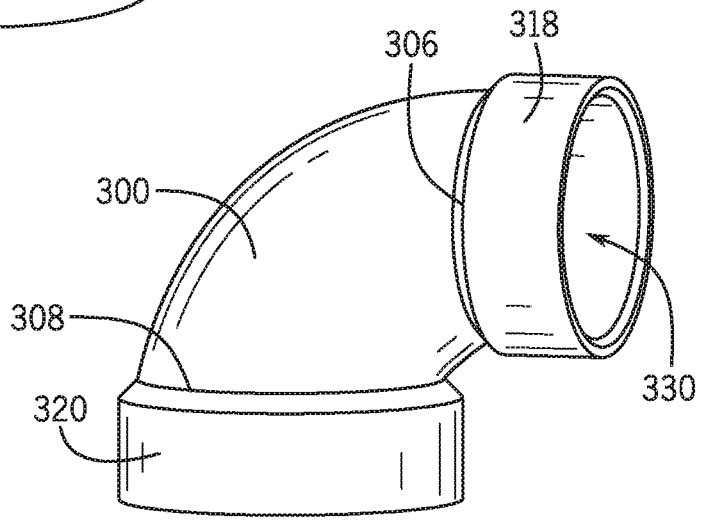
Figure 6:
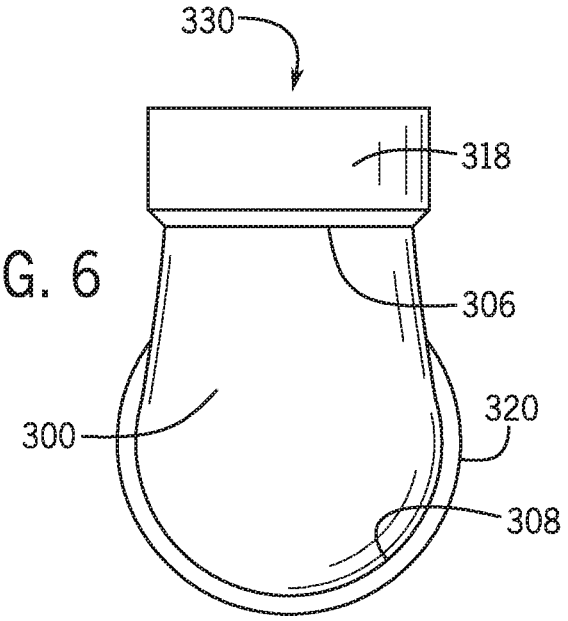
Figure 7:
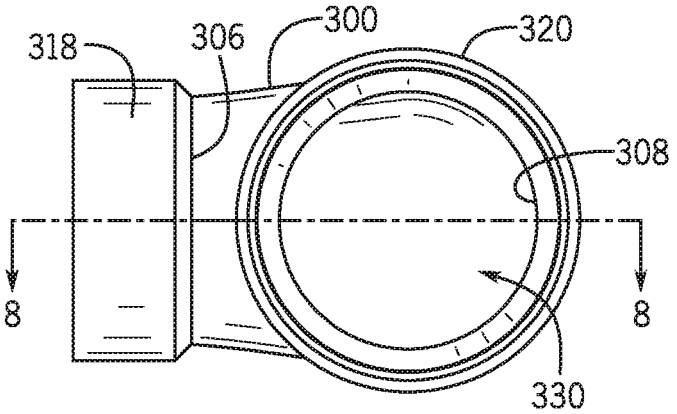
Figure 8:
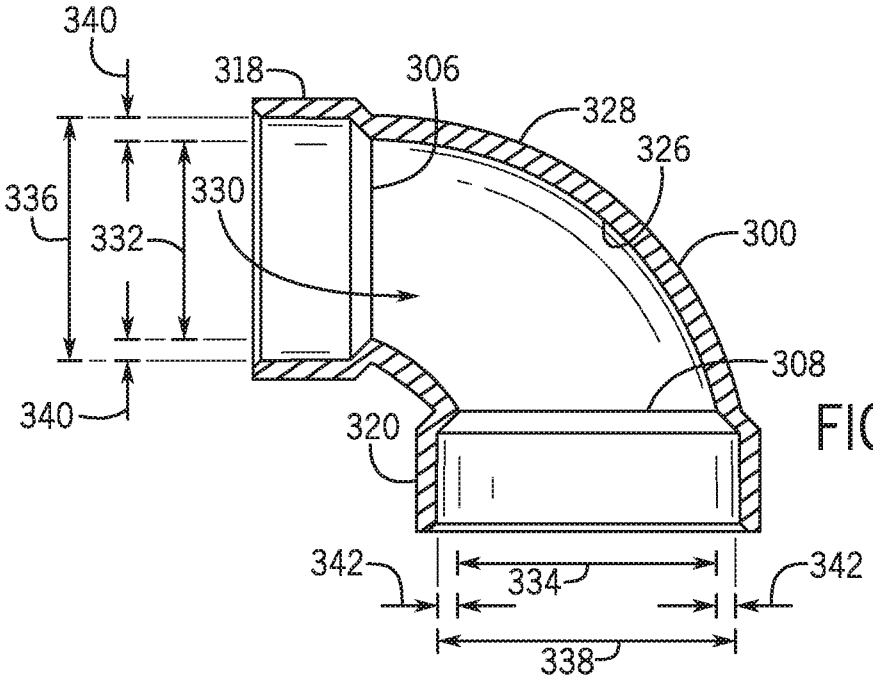
Figure 9:
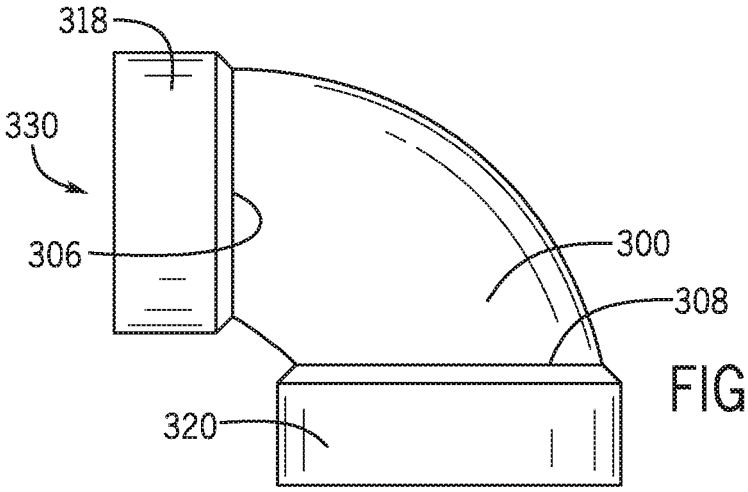

Referring now to FIG. 3, the drainage system 124 is shown in greater detail, in accordance with an exemplary embodiment. The drainage system 124 is shown to include an inlet elbow 300, a u-bend conduit 302, and an outlet elbow 304. Each of the inlet elbow 300, u-bend conduit 302, and outlet elbow 304 include corresponding inlets and outlets. Accordingly, the inlet elbow 300 may include an inlet 306 and an outlet 308, the u-bend conduit 302 may include an inlet 310 and an outlet 312, and the outlet elbow 304 may include an inlet 314 and an outlet 316.

As shown in FIG. 3, the inlet elbow 300 is fluidly connected to the outlet 114 of the basin drain 112. Fluidly connected, as used herein, includes any connection that allows for fluid flow between two connected conduits. The inlet elbow 300 may be screwed into, pushed into, or otherwise connect to the outlet 114. Additionally, the inlet 306 may include a sleeve 318 that surrounds the outlet 114 of the basin drain 112. Adhesive may be provided within an interior surface of the sleeve 318 that contacts an exterior surface of the outlet 114 of the basin drain 112. As the inlet elbow 300 is attached to the outlet 114 and when the adhesive dries, the inlet elbow 300 may be fluidly connected to the outlet 114 of the basin drain 112. Note that each of the fluid connections described herein may be made in a similar manner. A sleeve 320 may be provided at the juncture between the outlet 308 for the inlet elbow 300 and the inlet 310 for the u-bend conduit 302, a sleeve 322 may be provided at the juncture between the outlet 312 for the u-bend conduit 302 and the inlet 314 for the outlet elbow 304, and a sleeve 324 may be provided at the juncture between the outlet 316 for the outlet elbow 304 and the fluid drain inlet 126. Each of the sleeves 320, 322, 324 may surround an exterior surface of one of the inlets/outlets at the juncture. Adhesive may be provided on an interior surface of each of the sleeves 320, 322, 324 and, once dried, the corresponding components may be fluidly connected.

When the outlet 114 of the basin drain 112 is fluidly connected to the inlet elbow 300, the inlet elbow 300 is fluidly connected to the u-bend conduit 302, the u-bend conduit 302 is fluidly connected to the outlet elbow 304, and the outlet elbow 304 is fluidly connected to the fluid drain inlet 126, water from the interior portion 108 of the bath basin 102 may be drained from the basin drain 112, through the drainage system 124, and out the fluid drain inlet 126 to a main fluid drain.

The inlet elbow 300, u-bend conduit 302, and outlet elbow 304 are shown to form a trap (e.g., a p-trap). Accordingly, the inlet 306 of the inlet elbow 300 and the outlet 316 of the outlet elbow 304 may extend vertically. Additionally, the outlet 308 of the inlet elbow 300 and the inlet 314 of the outlet elbow 304 may extend horizontally. Correspondingly, the u-bend conduit 302 may be positioned such that the inlet 310 and outlet 312 are positioned horizontally. Additionally, the u-bend conduit 302 may be positioned beneath the inlet 306 of the inlet elbow 300 and the outlet 316 of the outlet elbow 304. When water is drained from the interior portion 108 of the bath basin 102, the water may flow through the trap formed by the inlet elbow 300, u-bend conduit 302, and outlet elbow 304. Following draining of the interior portion 108, some water may be maintained in the u-bend conduit 302 (due to its location with respect to the inlet elbow 300 and outlet elbow 304 and resulting gravitational effects). The water maintained in the u-bend conduit 302 may act as a filter to prevent gas from flowing from the main fluid drain, back through the drainage system 124, and into the ambient air (e.g., up through the basin drain 112).

Referring now FIGS. 4-9, in some embodiments, one or both of the elbows (e.g., the inlet or outlet elbow 300, 304) may have varying internal diameters between their respective inlets and outlets. Specifically, FIG. 4-FIG. 9 show various views of an elbow of the drainage system 124, according to exemplary embodiments. The elbow may permit a 90° turn of water between the inlet and outlet of the elbow 300. While the elbow 300 shown in FIG. 4-FIG. 9 is the inlet elbow 300, the same description may be applicable to the outlet elbow 304, as will be discussed in further detail below with reference to FIG. 10.

The inlet elbow 300 may include an interior wall 326 and an exterior wall 328. In some embodiments, the interior and exterior walls 326, 328 may be separated by insulation. In other embodiments, the interior and exterior walls 326, 328 may be opposing surfaces of the same material. For instance, the material may be a metal, such as copper, aluminum, etc., a plastic, such as polyvinyl chloride (PVC), etc. In some embodiments, the interior and exterior walls 326 may define an interior channel 330. The interior channel 330 may be the channel in which water traverses while passing through the inlet elbow 300. While the above description is provided for the inlet elbow 300, similar description is applicable to the u-bend conduit 302, the outlet elbow 304, etc. Accordingly, each of these components may be constructed of a metal or plastic material and have corresponding interior and exterior walls which define corresponding internal channels. Collectively, water is routed from the basin 102, through these internal channels, to the main fluid drain.

As described above, the inlet elbow 300 includes an inlet 306 and an outlet 308. When fluidly connected within the drainage system 124, the inlet 306 may extend vertically and the outlet 308 may extend horizontally. The outlet 308 may have a greater size than the inlet 306. Accordingly, the inlet 306 and outlet 308 may be fluidly coupled to conduits having different sizes. The conduit coupled to the outlet 308 of the inlet elbow 300 (e.g., the u-bend conduit 302) may have a greater size than the conduit coupled to the inlet 306 of the inlet elbow 300 (e.g., the outlet 114 of the basin drain 112). For instance, in some embodiments, the outlet 114 of the basin drain 112 may have an inner diameter of 1.5", and the inlet 310 of the u-bend conduit 302 may have an inner diameter of 2.0". Accordingly, the inlet 306 of the inlet elbow 300 may have an inner diameter 332 of 1.5", and the outlet 308 of the inlet elbow 300 may have an inner diameter 334 of 2". While this embodiment is described, the present disclosure is not limited to these particular inner diameters. Rather, the present disclosure contemplates other dimensions for the elbow 300 which change between the inlet 306 and outlet 308.

In some embodiments, the elbow 300 may taper between the inlet 306 and the outlet 308. The inner diameter of the elbow 300 may progressively change from the inlet 306 to the outlet 308. "Progressive" as used herein, means a smooth rate of change of the inner diameter of the interior channel between the inlet and the outlet. For instance, the inner diameter of the interior channel 330 may progressively get larger between the inner diameter 332 to the inlet 306 to the inner diameter 308 of the outlet 308. In this regard, the inner diameter of the interior channel 330 may taper from the outlet 308 to the inlet 306. In so doing, the elbow may accommodate for different sized conduits at the inlet 306 and outlet 308. Specifically, the elbow accommodates for larger conduits at the outlet 308 and smaller conduits at the inlet 306. In providing the progressive change of the inner diameter, such arrangements may inhibit or prevent particulate build-up within the interior channel 330. Additionally, such arrangements may provide unobstructed fluid flow through the elbow 300. Thus, the arrangements described herein may permit an increased fluid flow rate through the drainage system 124 by connecting to a u-bend conduit 302 with a larger inner diameter, and by providing a progressive changing of the inner diameter of the elbow 300 to inhibit obstruction.

The u-bend conduit 302 may have a constant (or near-constant) inner diameter across the u-bend conduit 302 (e.g., the inner diameter for the internal channel of the u-bend conduit 302 is constant or near-constant throughout). The u-bend conduit 302 may have the same inner diameter as the inner diameter 334 at the outlet 308 of the inlet elbow 300. Accordingly, when the u-bend conduit 302 is fluidly connected to the outlet 308 of the inlet elbow 300, the inner diameters at the juncture between the outlet 308 of the inlet elbow 300 and inlet 310 of the u-bend conduit 302 may be the same (or substantially the same). Similarly, the u-bend conduit 302 may have the same inner diameter as the inner diameter of the inlet 314 of the outlet elbow 304. Accordingly, when the u-bend conduit 302 is fluidly connected to the inlet 314 of the outlet elbow 304, the inner diameters at the juncture between the outlet 312 of the u-bend conduit 302 and inlet 314 of the outlet elbow 304 may be the same (or substantially the same). As such, the arrangements described herein may maintain continuity of the conduits (e.g., the inlet elbow 300, u-bend conduit 302, and outlet elbow 304).

Where the inlet elbow 300 accommodates for larger conduits at the outlet 308 and smaller conduits at the inlet 306, such arrangements may increase a rate of fluid flow through the inlet elbow 300. For instance, water may flow through the inlet elbow 300 at a faster rate due to the change from the inner diameter 332 at the inlet 306 to the inner diameter 334 at the outlet 308 and the conduit connected thereto (e.g., the u-bend conduit 302). Accordingly, water may be drained from the interior portion 108 of the bath basin 102 due to the increased rate of fluid flow through the inlet elbow 300 (and u-bend conduit 302).

As described above, the inlet 306 and outlet 308 of the inlet elbow 300 may include corresponding sleeves 318, 320. The sleeves 318, 320 may have an inner diameter 336, 338 which is greater than the inner diameter 332, 334 of the inlet 306 and outlet 308, respectively. The sleeves 318, 320 may surround the conduit which is connected to the inlet elbow 300. For instance, the sleeve 318 for the inlet 306 may surround the outlet 114 of the basin drain 112. The inner diameter 336 of the sleeve 318 may be equal to the sum of the inner diameter 332 and twice the thickness 340 of the outlet 114 of the basin drain 112 so as to accommodate for receiving the outlet 114. Similarly, the inner diameter 338 of the sleeve 320 may be equal to the sum of the inner diameter 334 and twice the thickness 342 of the inlet 310 of the u-bend conduit 302 so as to accommodate for receiving the inlet 310.

Figure 10:
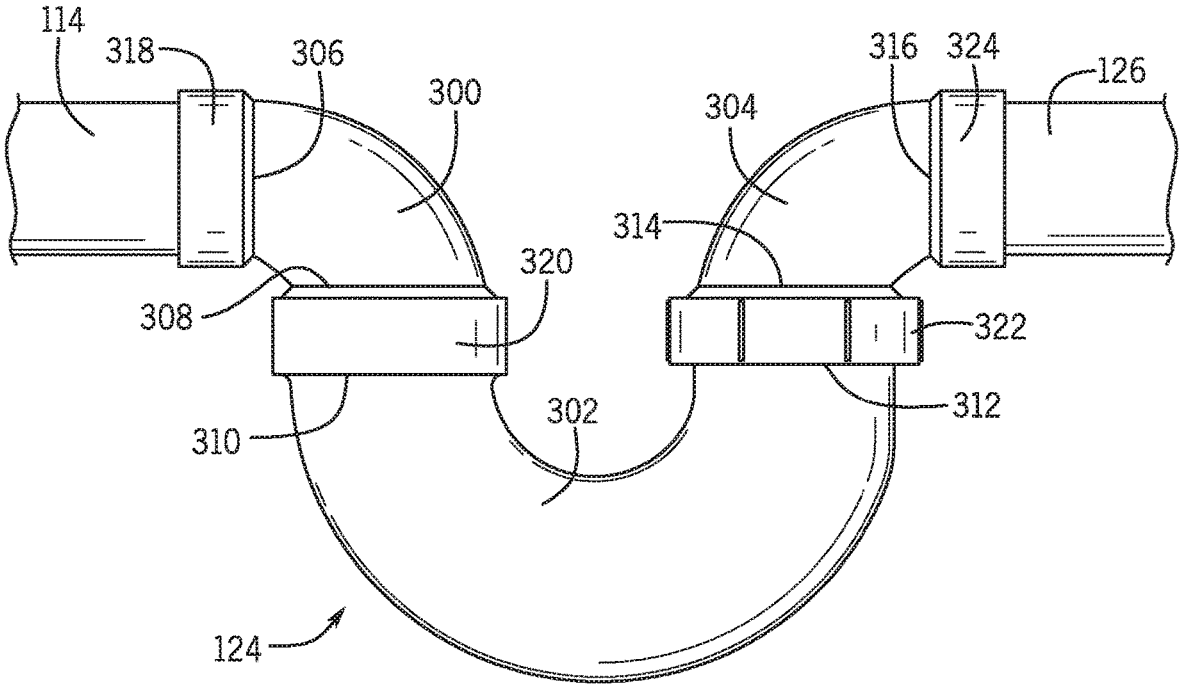
FIG. 10 is another drainage system implemented in the example bathtubs of FIG. 1 and FIG. 2, according to an exemplary embodiment.

Referring now to FIG. 3 and FIG. 10, in some embodiments, the outlet 316 of the outlet elbow 304 may have different sizes depending on application. For instance, depicted in FIG. 10 is an example drainage system 124, according to another exemplary embodiment. In the embodiment depicted in FIG. 10, the outlet 316 of the outlet elbow 304 is substantially the same size as the inlet 306 of the inlet elbow 300. In this embodiment, the outlet elbow 304 and inlet elbow 300 may be substantially the same (albeit, these elbows 304, 306 may be a mirror image with respect to the u-bend conduit 302).

According to the embodiment depicted in FIG. 10, the outlet 114 for the basin drain 112 may be substantially the same size as the fluid drain inlet 126. For instance, the outlet 114 and fluid drain inlet 126 may each have a 1.5" inner diameter. In these embodiments, the inlet 306 of the inlet elbow 300 and the outlet 316 of the outlet elbow 304 may each have an inner diameter of 1.5". According to these embodiments, water may flow from the interior portion 108 of the bath basin 102 out of the outlet 114 (with a 1.5" diameter), through the inlet elbow 300, and into the inlet 310 of the u-bend conduit 302 (with a 2.0" diameter). The water may then flow through the outlet 312 of the u-bend conduit 302 (with a 2.0" diameter), through the outlet elbow 304, and into the fluid drain inlet 126 (with a 1.5" diameter in FIG. 10 and a 2.0" diameter in FIG. 3). While these dimensions are provided, the present disclosure is not limited to these dimensions.

According to the embodiments described herein, water may flow though the drainage system 124 at a rate faster than standard drainage systems. Accordingly, water may be drained from the interior portion 108 of the bath basin 102 at a faster rate. Therefore, bathers may not be required to wait as long to exit the bath basin 102—particularly where the bathtub 100 is a walk-in bathtub.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the mirror assembly as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" or as an "example" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A bath or sink basin drainage system, comprising:

a basin defining an interior portion;

a basin drain arranged towards a bottom of the interior portion of the basin, the basin drain having an outlet for draining water from the interior portion of the basin; and a drainage system forming a p-trap and comprising:

a first elbow having an inlet, which has a first inner diameter and is fluidly connected to the outlet of the basin drain, and an outlet, which has a second inner diameter that is larger than the first inner diameter;

a u-bend conduit having an inlet, which is fluidly connected to the outlet of the first elbow, and an outlet, wherein an inner diameter of each of the inlet and the outlet of the u-bend conduit is the same size as the second inner diameter of the outlet of the first elbow; and a second elbow having an inlet, which is fluidly connected to the outlet of the u-bend conduit, and an outlet, which is configured to connect to a fluid drain inlet.

2. The basin drainage system of claim 1, wherein the inlet of the first elbow and the outlet of the second elbow each have the first inner diameter.

3. The basin drainage system of claim 2, further comprising:

a fluid drain inlet, which has the first inner diameter, and receives water from the interior portion of the basin via the drainage system.

4. The basin drainage system of claim 1, wherein the first elbow tapers between the inlet and the outlet.

5. The basin drainage system of claim 4, wherein an inner diameter of an interior channel of the first elbow progressively changes between the inlet and the outlet.

6. The basin drainage system of claim 1, wherein the basin drain extends substantially vertically.

7. The basin drainage system of claim 6, wherein the inlet of the first elbow is indirectly connected to the outlet of the basin drain, and wherein the drainage system further comprises a third elbow connected between the inlet of the first elbow and the outlet of the basin drain.

8. The basin drainage system of claim 1, wherein the outlet of the basin drain extends substantially horizontally.

9. A walk-in bathtub, comprising:

a bath basin defining an interior portion;

a door pivotable inwardly towards the interior portion of the bath basin;

a bath drain arranged towards a bottom of the interior portion of the bath basin, the bath drain having an outlet for draining water from the interior portion of the bath basin; and a drainage system forming a p-trap, the drainage system comprising:

a first elbow having an inlet, which has a first inner diameter and is fluidly connected to the outlet of the bath drain, and an outlet, which has a second inner diameter that is larger than the first inner diameter;

a u-bend conduit having an inlet, which is fluidly connected to the outlet of the first elbow, and an outlet, wherein an inner diameter of each of the inlet and the outlet of the u-bend conduit is the same size as the second inner diameter of the outlet of the first elbow; and a second elbow having an inlet, which is fluidly connected to the outlet of the u-bend conduit, and an outlet, which is configured to connect to a fluid drain inlet.

10. The walk-in bathtub of claim 9, wherein the outlet of the second elbow has the first inner diameter.

11. The walk-in bathtub of claim 10, further comprising:

a fluid drain inlet, which has the first inner diameter, and receives water from the interior portion of the bath basin via the drainage system.

12. The walk-in bathtub of claim 9, wherein the outlet of the bath drain and the inlet of the fluid drain have the same inner diameter, and wherein the u-bend conduit has an inner diameter greater than the outlet of the bath drain and the inlet of the fluid drain.

13. A drainage system for a bathtub, the drainage system comprising:

a first elbow having an inlet, which has a first inner diameter and is configured to fluidly connect to an outlet of a basin drain that is arranged to drain water from an interior portion of a bath basin, and an outlet which has a second inner diameter that is larger than the first inner diameter;

a u-bend conduit having an inlet, which is fluidly connected to the outlet of the first elbow, and an outlet, wherein an inner diameter of each of the inlet and the outlet of the u-bend conduit is the same size as the second inner diameter of the outlet of the first elbow; and a second elbow having an inlet, which is fluidly connected to the outlet of the u-bend conduit, and an outlet which is configured to connect to an inlet of a fluid drain.

14. The drainage system of claim 13, wherein the inlet of the first elbow and the outlet of the second elbow each have the first inner diameter.

15. The drainage system of claim 13, wherein the first elbow tapers between the inlet and the outlet.

16. The drainage system of claim 15, wherein an inner diameter for the first elbow gradually increases between the inlet and the outlet.

17. The drainage system of claim 13, wherein the inlet and outlet of the second elbow each have the second inner diameter.

18. The drainage system of claim 13, wherein the bath drain extends substantially vertically.

19. The drainage system of claim 18, further comprising:

a third elbow connectable between the inlet of the first elbow and the outlet of the bath drain.

20. The drainage system of claim 13, wherein the outlet of the bath drain extends substantially horizontally.

* * * * *